United States Patent [19]

Takasugi

[11] Patent Number: 4,759,535

[45] Date of Patent: Jul. 26, 1988

[54] MACHINE VICE

[76] Inventor: Tamotsu Takasugi, 2307-5 Iharacho, Ihara-shi, Okayama-ken, Japan

[21] Appl. No.: 942,673

[22] Filed: Dec. 17, 1986

[30] Foreign Application Priority Data

May 31, 1986 [JP] Japan ..... 61-127096
May 31, 1986 [JP] Japan ..... 61-127097

[51] Int. Cl.[4] ..... B25B 1/10
[52] U.S. Cl. ..... 269/246; 269/285
[58] Field of Search ..... 269/246, 250, 251, 101, 269/216, 285

[56] References Cited

U.S. PATENT DOCUMENTS 2,882,656 4/1959 Novkov ..... 269/289
3,312,461 4/1967 Copron ..... 269/246
4,221,369 9/1980 Takasugi ..... 269/250
4,295,641 10/1981 Boucher ..... 269/285
4,569,509 2/1986 Good ..... 269/246
4,664,365 5/1987 Heine ..... 269/246

FOREIGN PATENT DOCUMENTS 55-65043 5/1980 Japan .

*Primary Examiner*—Robert C. Watson
*Attorney, Agent, or Firm*—Oblon, Fisher, Spivak, McClelland & Maier

[57] ABSTRACT

A machine vice comprises an elasticity-adjustment rod secured to and penetrating one of two vertical portions of a subtantially U-shaped stress-transmission frame such that the one end of the frame is in contact with a vice head having a stationary jaw and a guide rail, whereby the flexing and strain of the stationary jaw resulting when a work is clamped between the stationary and movable jaws is compensated for, thus ensuring the perpendicularity of the stationary jaw with respect to the guide rail top surface and parallelness of the two jaws.

9 Claims, 6 Drawing Sheets

MACHINE VICE

FIELD OF THE INVENTION AND RELATED ART STATEMENT

This invention relates to a machine vice for reliably securing a work and, more particularly, to a machine vice, in which high parallelness can be maintained between a movable jaw and a stationary jaw even when a work is firmly clamped between the jaws by advancing the movable jaw against the stationary jaw, thus permitting highly precise machining.

In the ordinary machine vice, a given work is clamped between a movable jaw and a stationary jaw by advancing the movable jaw against the stationary jaw by operating a clamping screw. When the work is firmly clamped, however, the guide rail for guiding the movable jaw flexes. When the guide rail flexes, the parallelness between the movable jaw and stationary jaw is lost, and the work experiences a force tending to cause it to float away from the guide rail, thus causing an instably clamped state of the work or failing to clamp the work.

In order to maintain the parallelness between the movable jaw and stationary jaw when clamping the work, it is convenient to increase the rigidity of the frame body supporting these jaws. In other words, the reaction force against the force with which the movable jaw is urged against the work to be clamped may be received and resisted by a frame having high rigidity. When this method is adopted in its simplest form, the apparatus is inevitably increased in size and weight, which is undesirable from the standpoints of handling and cost of manufacture.

Accordingly, a machine vice has been proposed in which the stationary and movable jaws are coupled together by a frame having high rigidity and U-shaped sectional profile so as to maintain the parallelness between the two jaws against the reaction force produced when the work is clamped between the two jaws, as disclosed in Japanese Patent Publications SHO 56-20213 and SHO 60-23950 and U.S. Pat. No. 4,221,369.

Even where the stationary and movable jaws are secured together by the high rigid U-shaped frame, when the work is forcibly clamped, the stationary and/or movable jaws are liable to get out of the perpendicularity with respect to the guide rail on which the work is supported on the micron order due to such cause as flexing of the U-shaped frame.

This will now be described with reference to FIG. 1. Referring to FIG. 1 there is shown a machine vice. The machine vice comprises a vice head 1 which integrally includes a stationary jaw 2 with a jaw plate **2*a* and a horizontal guide rail 3. The vice head 1 is secured to one end of a rigid U-shaped frame 4. A movable jaw 5 with a jaw plate 5*a* is provided for horizontal movement along the top of the horizontal guide rail 3. In the movable jaw 5 is provided a drive screw 6 which penetrates a bearing 7 provided at the other end of the U-shaped frame 4. The movable jaw 5 is advanced and retreated by turning the drive screw 6 with a manual crank (not shown) or the like which is coupled to a non-circular rear end 6*a* of the drive screw 6**.

When a given work W is strongly clamped between the jaw plates **2*a* and 5*a* of the stationary and movable jaws 2 and 5 by turning the drive screw 6 to advance the movable jaw 5, the U-shaped frame 4 is flexed, as shown by phantom lines. The perpendicularity of the jaw plate 2*a* with respect to the guide rail 3** thus is lost, and a flexing deviation $\delta$ is produced. Unless such flexing is suppressed, it is impossible to attain machining with a high precision on the submicron order.

OBJECT AND SUMMARY OF THE INVENTION

An object of the invention is to provide a machine vice having a stationary jaw and a movable jaw both supported on a U-shaped frame, which can minimize the flexing and inclination of the stationary jaw and ensure the perpendicularity of the clamping surfaces with respect to the guide rail and parallelness between the jaws with respect to each other even when a given work is strongly clamped between the stationary and movable jaws, so that it is suitable for high precision machining.

To attain the above object of the invention, there is provided a machine vice, which comprises a vice head having a stationary jaw and a guide rail, a substantially U-shaped stress-transmission frame having one end secured to the stationary jaw, a movable jaw provided for advancement and retreat on the guide rail and facing the stationary jaw, and an elasticity-adjustment rod penetrating the stress-transmission frame and having a free end in contact with the rear end of the stationary jaw or a front end of the guide rail.

With one end of the stress-transmission frame coupled to an upper portion of the back surface of the stationary jaw front wall and with the free end of the elasticity-adjustment rod provided in the stress-transmission frame in contact with a lower portion of the back surface of the stationary jaw, even when the work is strongly clamped between the movable and stationary jaws, the lower portion of the stationary jaw is urged by the elasticity-adjustment rod. Thus, the perpendicularity of the stationary jaw with respect to the guide rail can be maintained. Further, similar effects can be obtained with the end of the guide rail received by an elastic adjustment rod secured to and penetrating the stress-transmission frame.

Further, with a lower portion of the screw bearing side portion of the stress-transmission frame urged by another elasticity-adjustment rod provided on the vice head, it is possible to suppress the elongation of the stress-transmission frame that occurs at the time of the clamping of the work.

The above and other objects and features of the invention will become more apparent from the following detailed description with reference to the accompanying drawings.

DETAILED DESCRIPTION OF THE PREFERRED EMBODIMENT

Figure 1:
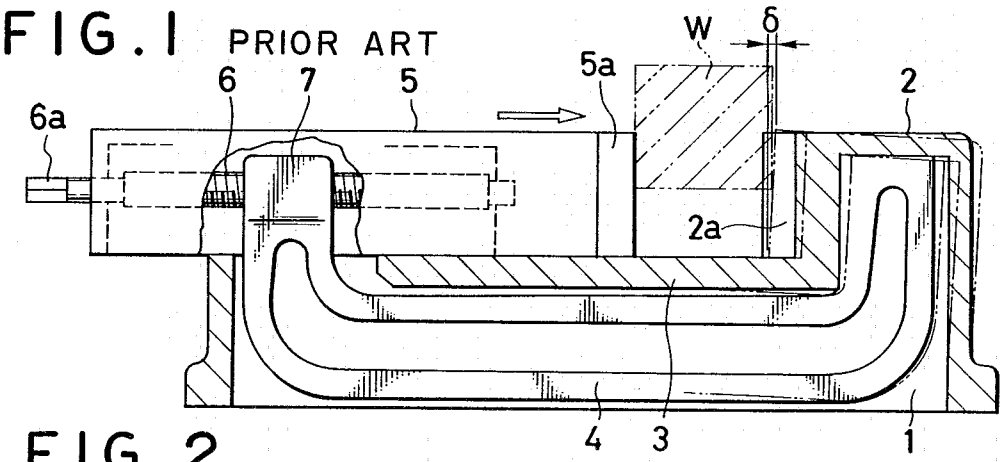
FIG. 1 PRIOR ART
FIG. 1 is a schematic view for explaining the reaction produced when a work is clamped in a prior art machine vice.
Figure 2:
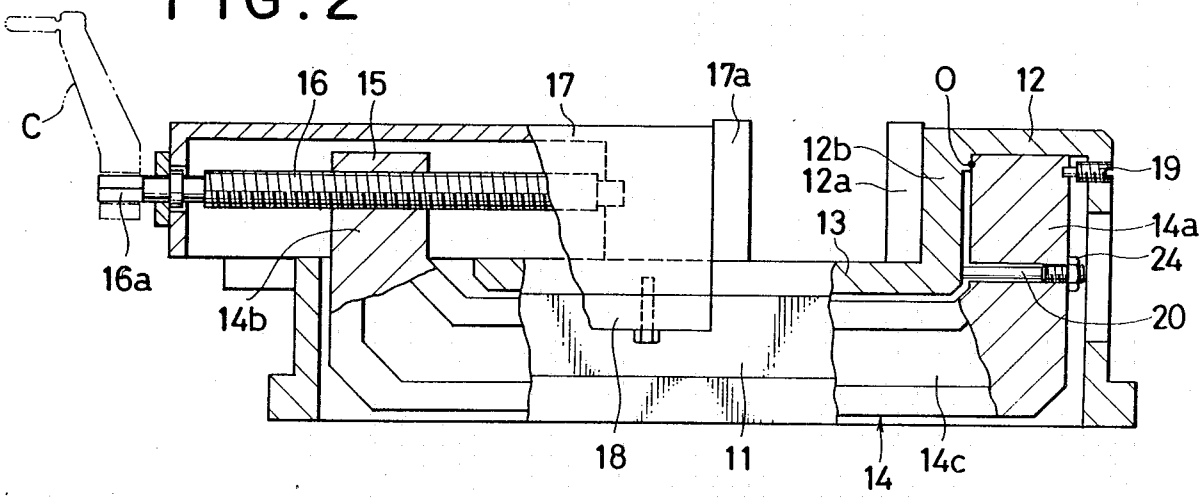
FIG. 2 is a schematic side view, partly broken away, showing an embodiment of the machine vice according to the invention.
Figure 3:
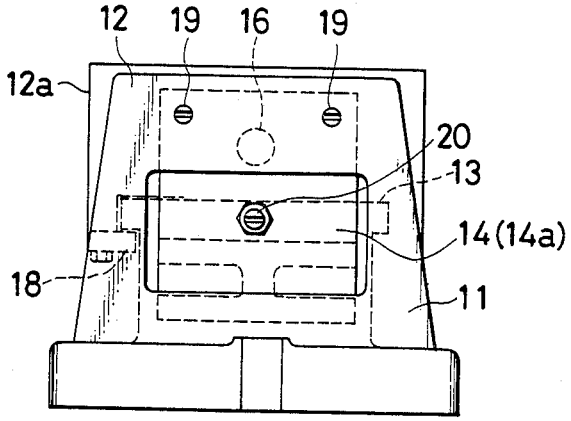
FIG. 3 is a front view showing the same machine vice.

FIGS. 2 and 3 show a first embodiment of the machine vice according to the invention. The illustrated machine vice comprises a vice head 11, which includes a stationary jaw 12 and a guide rail 13, a substantially U-shaped stress-transmission frame 14, which has an upright portion 14*a* provided at one end and is coupled at the top to the stationary jaw 12 and another upright portion 14*b* provided at the other end and having a screw bearing 15, and a movable jaw 17 which is moved along the top of the guide rail 13 by turning a drive screw 16 rotatably supported by the bearing 15. A horizontal portion 14*c* between the two upright portions 14*a* and 14*b* of the stress-transmission frame 14 extends over the entire length of the inner space of the vice head 11, and it is substantially parallel to the guide rail 13.

Although the stationary and movable jaws 12 and 17 are provided with the jaw plates 12*a* and 17*a* facing each other, these jaw plates are not essential elements. In operation, the work between the jaw plates 12*a* and 17*a* can be clamped and unclamped by turning the drive screw 16 with a manual crank C coupled to a non-circular end portion 16*a* of the drive screw 16. The axis of the drive screw 16 is located at a level below a coupling/support point 0 of the upper ends of the stationary jaw 12 and vertical portion 14*a* of the stress-transmission frame 14.

The guide rail 13 has a flat and smooth top surface so that the work can be horizontally and stably placed thereon. As shown in FIG. 3, the guide rail has a substantially T-shaped sectional profile with its top portion having opposite side extensions.

The movable jaw 17 straddles the guide rail 13 and has a guide member 18 secured to the lower end of a depending side portion on the outer side of the guide rail.

The substantially U-shaped stress-transmission frame 14 has a turned-down H-shaped sectional profile. However, this sectional profile is by no means limitative, and any sectional profile may be adopted so long as the rigidity can be effectively enhanced. The stress-transmission frame 14 and vice head 11 are secured together by a set screw 19 which is screwed in the rear wall of the stationary jaw 12.

Figure 4:
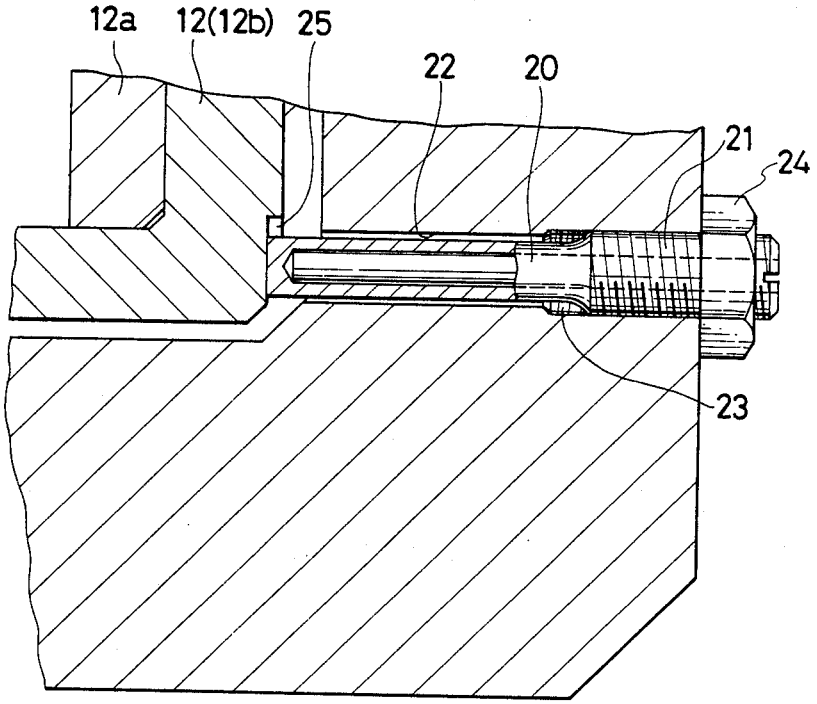
FIG. 4 is a fragmentary enlarged, sectioned side view showing an elasticity-adjustment rod mounting structure in the machine vice shown in FIG. 2.

Reference numeral 20 designates an elasticity-adjustment rod which horizontally penetrates the stress-transmission frame 14 and has a free end in contact with a lower portion of the back surface of the front wall 12*b* of the stationary jaw 12. FIG. 4 shows the elasticity-adjustment rod 20 in this embodiment. This rod 20 is hollow and has a rear threaded portion 21. Meanwhile, the stress-transmission frame 14 is formed with a horizontal through-hole 22 for receiving the elasticity-adjustment rod 20. A rear portion of the through-hole 22 is formed with a female thread 23. The rod 20 is inserted into the through-hole 22, and its threaded portion 21 is screwed in the female thread 23. The rod 20 is screwed until its free end lightly touches the back surface of the front wall 12*b* of the stationary jaw 12 in the normal state, i.e., when no work is clamped.

To prevent detachment and looseness of the rod 20, a lock nut 24 is tightened on the portion of the rod 20 projecting from the through-hole 22. In FIG. 4, a depression 25 is provided in a portion of the back surface of the front wall 12*b* of the stationary jaw 12 in contact with the rod 20, but it is not essential. The elasticity-adjustment rod 20 is substantially in contact with the stationary jaw 12 at a position near the lower end of the stationary jaw 12 and substantially at the same level as the guide rail 13.

The elasticity-adjustment rod 20 is made of high tension steel, and it may be either hollow or solid so long as it can ensure a given sectional area.

The operation of this embodiment will now be described. To machine a given work, the work is clamped between the jaw plates 12*a* and 17*a* of the stationary and movable jaws 12 and 17 by advancing the movable jaw 17 by turning the drive screw 16. However, since the upper end portion of the stationary jaw 12 is coupled to and supported by the upper end of the vertical portion 14*a* of the stress-transmission frame 14, when a strong reaction force is produced, the front wall 12*b* of the stationary jaw experiences a counterclockwise rotational moment about the coupling/support point 0 in FIG. 2, and the lower portion of the front wall 12*b* tends to be retracted to the right. However, since the elasticity-adjustment rod 20 secured to the stress-transmission frame 14 is in contact with the back surface of the lower portion of the front wall 12*b* of the stationary jaw, a resistance is produced to prevent the lower portion of the front wall 12*b* from retreating and tilting. In this state, the vertical portion of the stress-transmission frame 14 is slightly flexed rearwardly to an extent less than the flexing of the front wall of the stationary jaw due to a clockwise rotational moment about the intersection between the vertical and horizontal portions 14*a* and 14*c* in FIG. 2. The vertical portion 14*a* of the frame is flexed in the opposite direction to the flexing of the front wall 12*b*. Therefore, where a structure to maintain a constant gap between the frame 14 and front wall 12*b*, e.g., with a projection formed on a lower portion of the vertical portion 14*a*, is adopted, the front wall 12*b* is also tilted in the same direction as the vertical portion 14*a* of the frame. In this embodiment, however, the elasticity-adjustment rod 20 is adapted to adequately absorb the stress of flexing of the frame 14 and front wall 12*b*. Thus, perpendicularity of the front wall 12*b* and jaw plate 12*a* with respect to the top of the guide rail 13 can be ensured.

The flexing of the stress-transmission frame and front wall of the stationary jaw varies according to the magnitude of the clamping force applied to the work, i.e., reaction force to the load. Accordingly, it is difficult to uniformly determine the optimum contact pressure of the elasticity-adjustment rod 20 relative to the front wall 12*b*. However, it is preferable to predetermine contact pressure of the maximum allowable limit as the result of using practically the machine vice with the elasticity-adjustment rod, so that the lock nut 24 can be set under the predetermined contact pressure.

In the case that the structure described above has been actually applied to a conventional machine vice having an ordinary structure, the maximum displacement between the top end and the bottom end of the stationary jaw 12b has been able to be reduced to less than 0.2μ. Thus, the vice machining can be carried out with accuracy.

As noted above, this invention places no restriction on the construction for providing the elasticity-adjustment rod on the machine vice, but it is required for the invention solely to use the elasticity-adjustment rod of high tensile steel, which intervenes between the stress-transmission frame and the stationary jaw.

Figure 5:
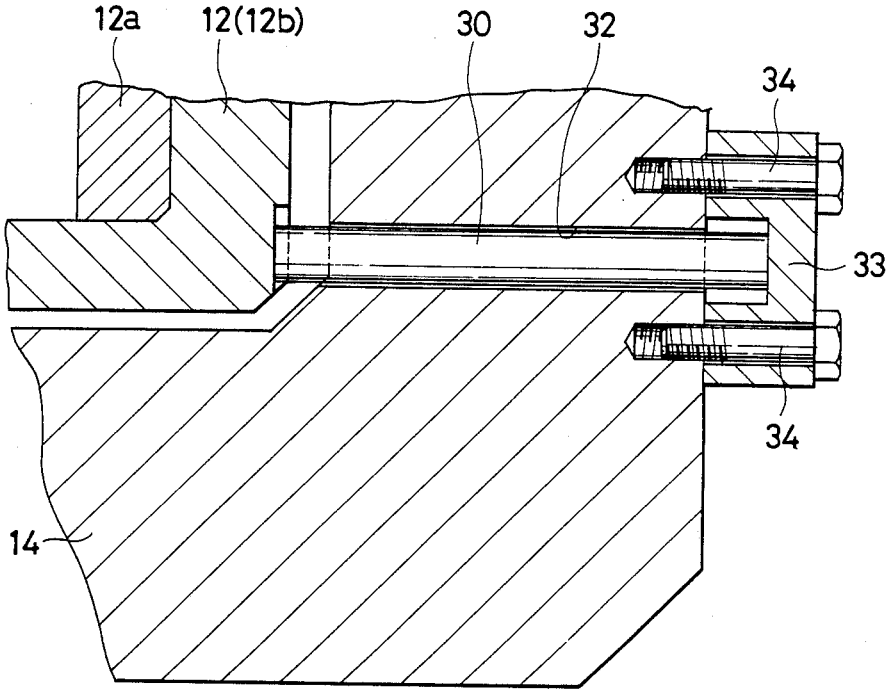
FIG. 5 is a fragmentary enlarged, sectioned side view showing a modification of the elasticity-adjustment rod mounting structure.

FIG. 5 shows a modification of the elasticity-adjustment rod of the invention. In the instant case, the elasticity-adjustment rod 30 is a solid straight rod of high tensile steel, and a rod 30 and a through-hole 32 of the frame 14 need not be provided with any thread.

The rear end of the rod 30 is retained and held in position by a cap-like retainer 33 which is secured by set screws 34 to the frame 14. The effective length of the rod 30 with respect to the front wall 12b of the stationary jaw can be easily adjusted not only by manipulating the set screws 34 but also by providing pad members (not shown) or like auxiliary members in the inside of the retainer 33.

Figure 6:
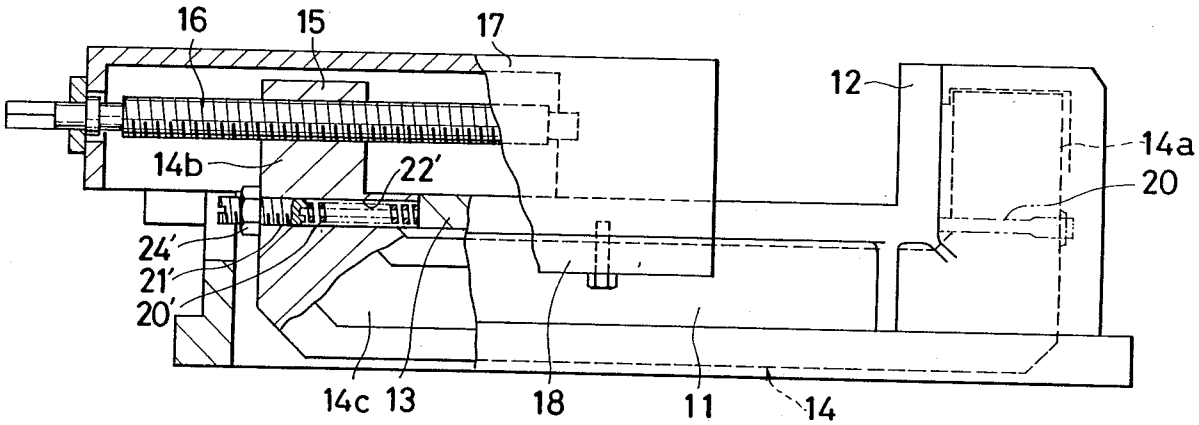
FIG. 6 is a schematic sectional view, partly broken away, showing another embodiment of the invention.

FIG. 6 shows a different embodiment of the machine vice. This embodiment is different in structure from the preceding embodiment in that a coil spring is provided in the movable jaw side vertical portion of the stress-transmission frame. In the machine vice of this embodiment, the stationary and movable jaws are not provided with any jaw plate. Without any jaw plate the machine vice can be used for machining. Of course it is possible to provide jaw plates appropriately to clamp the work. The components of the vice other than the portion concerning the coil spring 20' are the same as in the above embodiment, so they are designated by like reference numerals and are not described any further.

The coil spring 20' in this embodiment serves to provide additional load. The coil spring 20' is accommodated in a through-hole 22' which is formed in the vertical portion 14b of the stress-transmission frame 14 and extends in the direction of the horizontal extension of the guide rail 13. It has one end urged by a screw 21', and the other end is in contact with the corresponding end of the guide rail 13.

The screw 21' is screwed in a female thread of the hole 22' formed in the frame 14, and it is retained by a nut 24' screwed on its rear end portion projecting from the hole 22'.

The operation of this embodiment will now be described. In the manufacture of the machine vice it is difficult to make zero the error in the perpendicularity of the clamping surface of the stationary jaw 12. Actually, there occurs an error of approximately 2μ or less. To effect adjustment with respect to this error, the coil spring 20' is loaded by turning the screw 21' using a screw driver. The upper portion of the stationary jaw is pulled by the frame 14, i.e., by the force of the coil spring 20', toward the movable jaw 17, so that it is inclined in proportion to this force. As a method of adjustment in this case, the screw 21' is turned while measuring the perpendicularity of the stationary jaw, and when the proper perpendicularity is obtained, the screw 21' is secured in position with the nut 24'.

As an example, where a coil spring with an outer diameter of 12 mm, an inner diameter of 6 mm, a free length of 45 mm and a spring constant 4.0 is employed for a machine vice structure with a weight of 40 kg and a stationary jaw height of 50 mm, an inclination of 2μ is produced at the top of the stationary jaw clamping surface when the coil spring is compressed to 10.8 mm. It will be seen that the best perpendicularity of the stationary jaw clamping surface can be obtained in the manufacture of the machine vice so long as the error noted above is within the range of 2μ.

Figure 7:
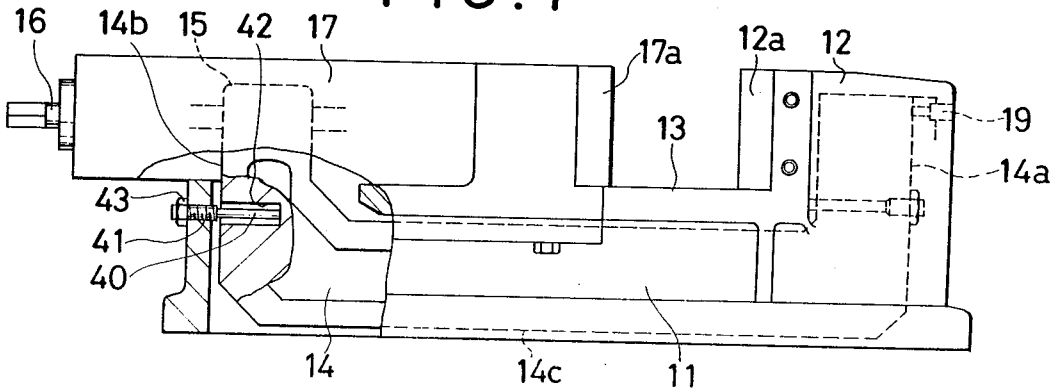
FIG. 7 is a schematic side sectional view, partly broken away, showing a further embodiment.

In the above embodiments the perpendicularity of the stationary jaw or the jaw plate thereof can be maintained by the action of the elasticity-adjustment rod. To further suppress the influence of the elongation or flexing of the horizontal portion of the stress-transmission frame 14, the same construction of the elasticity-adjustment rod may also be applied to the vertical portion 14b of the frame 14 on the side of the bearing 15, as shown in FIG. 7, in addition to the structure of the above embodiments. In this case, the elongation and/or flexing of the frame 14 can be further suppressed. More specifically, referring to FIG. 7, an elasticity-adjustment rod 40 having a rear threaded portion 41 like the rod shown in FIG. 4 is screwed in a threaded hole formed in the vice head 11 such that its free end is in contact with the bottom surface of a hole 42 formed in the stress-transmission frame 14. The shape, material and manner of installation of the elasticity-adjustment rod 40 are the same as in the case of FIG. 4. Also, like the previous embodiment the rod 40 is retained in the installed state by a lock nut 43.

Figure 8:
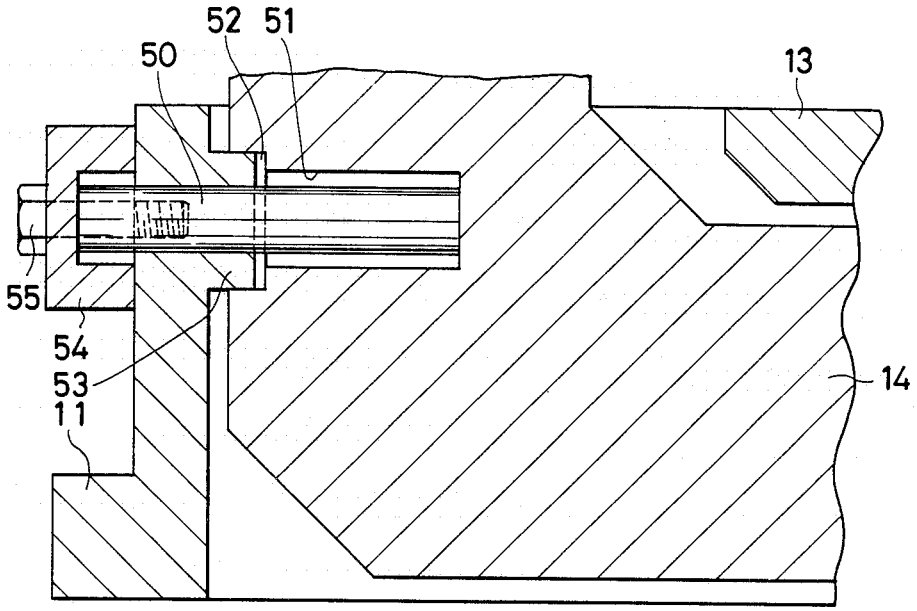
FIG. 8 is a fragmentary enlarged, sectioned side view showing a modification of the elasticity-adjustment rod mounting structure in the embodiment of FIG. 7.

FIG. 8 shows a modification of the structure of the elasticity-adjustment rod shown in FIG. 7. In this instance, the same structure as in the case of FIG. 5 is adopted. In this case, a hole 51 formed in the stress-transmission frame 14 to receive the elasticity-adjustment rod 50 has an increased diameter portion 52 adjacent to the open end. A projection 53 provided on the vice head 11 is received in the increased diameter portion 52. The elasticity-adjustment rod 50 has its rear end retained by a cap-like retainer 54 and is set by a set screw 55. The stress-transmission frame 14 and vice head 11 can be held in a proper positional relation to each other by the engagement between the increased diameter portion 52 of the hole 51 and projection 53.

The function of the elasticity-adjustment rods shown in FIGS. 7 and 8 will now be described. When the work is clamped between the jaw plates 12a and 17a, the reaction force acts on the horizontal portion of the stress-transmission frame 14 as well. Consequently, there occurs elongation and strain of the horizontal portion of the stress-transmission frame 14. The stress-transmission frame 14 is supported at the stationary jaw 12 by the set screw 19, and the reaction force acting on the stationary jaw 12 is distributed to the vice head 11 via the set screw 19. In this case, the elongation of the stress-transmission frame 14 or the flexing thereof due to the reaction force acting on the bearing 15 cannot be compensated for. However, the elongation of the horizontal portion of the frame 14 and flexing of the vertical portion thereof can be reduced with the elasticity-adjustment rod 40 held urged against the lower portion of the vertical portion of the stress-transmission frame 14 having the bearing 15. In other words, the elasticity-adjustment rod 40 has an elasticity effect of preventing the generation of rotational moment with respect to the point of its forced contact, thus contributing to the maintenance of the parallelness of the stationary and movable jaws.

Further, it is possible to incorporate the elasticity-adjustment rod in the embodiment shown in FIG. 7. In this case, the plurality of elasticity-adjustment rods co-operate with one another to provide an improved effect so that it is possible to realize a machine vice having high rigidity.

Figure 9:
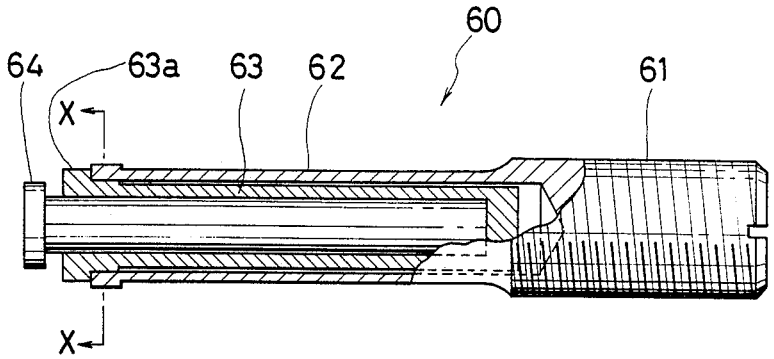
FIG. 9 is a partially sectioned side view of the elasticity-adjustment rod of still another embodiment.
Figure 10:
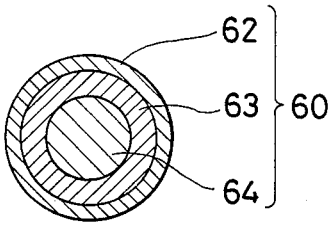
FIG. 10 is a cross-sectional view taken along line X—X of FIG. 9.

Although the elasticity-adjustment rod of a hollow construction as illustrated in FIG. 4 can be effectively used in the machine vice according to the invention because of its appropriate degree of resilience, there is a possibility that the rod will be plastically deformed by exposure to a reaction force exceeding the elastic limit thereof. To avoid the possibility of such plastic deformation, the elasticity-adjustment rod may be constructed as illustrated in FIGS. 9 and 10 so as to assure sufficient strength as well as appropriate elasticity. The rod 60 comprises a threaded portion 61 to be screwed in the through-hole formed in the stress-transmission frame 14, a hollow outer member 62 extending from the threaded portion 61, in the axial direction thereof, a hollow inner member 63 disposed in the outer member 62, and a core member 64 disposed in the inner member 63. Preferably, the outer member 62, inner member 63 and core member 64 are so constructed as to have substantially the same sectional area. The core member 64 is tightly fitted in the inner member 63, while the inner member 63 is loosely inserted in the outer member 62 and connected fast at its flange portion 63*a* to the outer member 62. Thus, the rod of this embodiment insures appropriate elasticity and sufficient strength, so that the rod is not deformed even when the pushing force against the stationary jaw increases.

As has been described in the foregoing, according to the invention the free end of the elasticity-adjustment rod penetrating and secured to the vertical portion of the stress-transmission frame is held in contact with the back surface of the front wall of the stationary jaw. Thus, even when the front wall of the stationary jaw experiences a rotational moment about the coupling point between its top and stress-transmission frame resulting from the application to the stationary jaw of the reaction force produced when the work is strongly clamped between the jaw plates of the stationary and movable jaws, it is possible to maintain the perpendicularity of the stationary jaw or the jaw plate thereof with respect to the guide rail because the stationary jaw front wall is adequately pushed back by the elasticity-adjustment rod in correspondence to strains produced in various parts. Thus, it is possible to clamp the work highly precisely.

Further, by adopting a dynamic elasticity-adjustment rod structure for the vertical portion of the stationary jaw on the stationary jaw side, complicated strain in the stationary jaw can be suppressed with the end of the guide rail.

Further, with the movable jaw side vertical portion of the stress-transmission frame urged with another elasticity-adjustment rod secured to the vice head, it is possible to effectively compensate for the flexing and elongation of the stress-transmission frame when the work is clamped. Thus, the machine vice can be used for highly precise machining.

Further, the structure according to the invention is applicable to a composite machine vice consisting of a row of a plurality of integral machine vices for machining an elongate and large-size work. Further the invention is applicable to the case where a movable jaw is driven hydraulically and also to a vice adopting a toggle mechanism. In either case, the error in perpendicularity resulting from the clamping of work can be held within $1\mu$, so that it is possible to obtain machining with a precision on the submicron order.

What is claimed is:

1. A machine vice comprising:

a vice head including a horizontal guide rail and a stationary jaw having a front wall perpendicular to said guide rail;

a stress-transmission frame having a substantially U-shaped form with a horizontal portion and vertical portions at the opposite ends of said horizontal portion, one of said vertical portions being coupled at its top to an upper portion of the back surface of the front wall of said stationary jaw;

a movable jaw placed on the top surface of said guide rail and movably supported by the other one of said vertical portions of said stress-transmission frame; and an elasticity-adjustment rod made of a high strength steel and adjustably secured to said stress-transmission frame in a state penetrating the stationary jaw side vertical portion of said stress-transmission frame and having a free end in contact with the back suface of the front wall of said stationary jaw.

2. The machine vice according to claim 1, wherein said elasticity-adjustment rod has a rear threaded portion, and said stress-transmission frame has a through-hole having a female thread portion, said elasticity-adjustment rod being adjustably screwed in said through-hole.

3. The machine vice according to claim 2, wherein said elasticity-adjustment rod is secured in a state mounted in said stress-transmission frame with a lock nut fitted on said threaded portion of said elasticity-adjustment rod.

4. The machine vice according to claim 1, wherein said elasticity-adjustment rod is a straight rod inserted through a through-hole formed in said stress-transmission frame and is secured in position with its rear end urged by a cap-like retainer by said set screws to said stress-transmission frame.

5. The machine vice according to claim 1, which further comprises another elasticity-adjustment rod secured to said vice head and having a free end in contact with the back surface of the movable jaw side vertical portion of said stress-transmission frame.

6. The machine vice according to claim 1, wherein the movable jaw side vertical portion of said stress-transmission frame has a screw bearing, a drive screw being rotatably supported in said screw bearing and coupled to said movable jaw.

7. The machine vice according to claim 1, wherein said stationary and movable jaws have respective jaw plates.

8. The machine vice according to claim 1, wherein said elasticity-adjustment rod has a hollow outer member, a hollow inner member put in said outer member, and a core member put in said inner member.

9. The machine vice as claimed in claim 1, wherein said free end of said elasticity-adjustment rod is in bearing contact with the back surface of the front wall of said stationary jaw at a point below said upper portion, said upper portion comprising the only portion of said front wall of said stationary jaw in contact with said stress-transmission frame.

* * * * *